US007931386B2

(12) United States Patent
Nall et al.

(10) Patent No.: US 7,931,386 B2
(45) Date of Patent: Apr. 26, 2011

(54) FLEXIBLE LED LIGHTING STRIPS INCLUDING OVERMOLDING ENCASEMENT AND ATTACHED PARALLEL ELECTRICAL CONDUCTORS

(75) Inventors: Jeffrey Nall, Brecksville, OH (US); Tomislav Stimac, Concord, OH (US); Chenyang Li, Shanghai (CN); Chunmei Gao, Shanghai (CN); Babi Koushik Saha, Brunswick, OH (US); Shanshan Xie, Shanghai (CN); Douglas R. Halley, Westlake, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 257 days.

(21) Appl. No.: 11/725,359

(22) Filed: Mar. 19, 2007

(65) Prior Publication Data

US 2008/0232103 A1 Sep. 25, 2008

(51) Int. Cl.
*F21S 4/00* (2006.01)
*F21V 27/00* (2006.01)
*H01R 33/76* (2006.01)

(52) U.S. Cl. ..... 362/249.02; 362/387; 362/457; 362/646

(58) Field of Classification Search ..... 362/217, 362/219, 222, 225, 249, 391, 800, 646, 374, 362/387, 249.02, 249.03, 249.04, 249.05, 362/457; 439/56, 391, 404, 399, 400, 417; 248/499, 500, 680, 68.1
See application file for complete search history.

(56) References Cited

U.S. PATENT DOCUMENTS

| | | | | |
|---|---|---|---|---|
| 2,339,093 | A * | 1/1944 | Metheny | 248/74.3 |
| 3,982,304 | A * | 9/1976 | Menshen | 248/68.1 |
| 4,562,518 | A * | 12/1985 | Kumagai | 362/249.01 |
| 5,095,413 | A * | 3/1992 | Goldberg | 362/249.01 |
| 5,415,562 | A * | 5/1995 | Matsumoto et al. | 439/399 |
| 5,577,930 | A * | 11/1996 | Dahlem et al. | 439/399 |
| 5,672,000 | A * | 9/1997 | Lin | 362/249.06 |
| 5,704,572 | A * | 1/1998 | Vogel et al. | 248/68.1 |
| 5,813,751 | A * | 9/1998 | Shaffer | 362/249.08 |
| 6,386,733 | B1 * | 5/2002 | Ohkohdo et al. | 362/249 |
| 6,660,935 | B2 | 12/2003 | Southard et al. | |
| 6,712,486 | B1 * | 3/2004 | Popovich et al. | 362/249.06 |
| 6,932,495 | B2 * | 8/2005 | Sloan et al. | 362/249.06 |
| 6,994,455 | B2 * | 2/2006 | Okabe et al. | 362/362 |
| 7,114,841 | B2 | 10/2006 | Aanegola et al. | |
| 7,156,686 | B1 | 1/2007 | Sekela et al. | |

(Continued)

FOREIGN PATENT DOCUMENTS

GB 2221357 A * 1/1990

(Continued)

*Primary Examiner* — Alan Cariaso
(74) *Attorney, Agent, or Firm* — Fay Sharpe LLP

(57) ABSTRACT

A flexible lighting strip includes an insulated flexible electrical power cord and spaced apart modules connected therewith. Each module includes a circuit board with a cavity, indentation, or opening and an encasing overmolding defining a fastener-receiving slot or opening aligned with the cavity, indentation, or opening of the circuit board. Power cord conductors are separated at the connection with each module to define a gap receiving a portion of the circuit board. A separate tiedown is secured to the power cord. Conductive elements receiving electrical power from the power cord and delivering electrical power to the circuit board include an insulation-displacing portion and a recess receiving at least a portion of the power cord and including a retaining barb or hook. An adhesive tape or strip is disposed over at least one overmolding opening to prevent water ingress to the circuit board.

19 Claims, 8 Drawing Sheets

U.S. PATENT DOCUMENTS

| | | | | |
|---|---|---|---|---|
| 7,160,140 | B1 | 1/2007 | Mrakovich et al. | |
| 7,165,863 | B1 | 1/2007 | Thomas et al. | |
| 7,241,031 | B2 * | 7/2007 | Sloan et al. | 362/373 |
| 7,687,288 | B2 * | 3/2010 | Saha et al. | 438/29 |
| 2003/0142492 | A1 | 7/2003 | Sommers | |
| 2005/0030765 | A1 | 2/2005 | Southard et al. | |
| 2005/0117339 | A1 * | 6/2005 | Pan | 362/249 |
| 2005/0207151 | A1 | 9/2005 | Aanegola et al. | |
| 2005/0221659 | A1 | 10/2005 | Mrakovich et al. | |
| 2005/0227529 | A1 | 10/2005 | Mrakovich et al. | |
| 2006/0035511 | A1 | 2/2006 | Mrakovich et al. | |
| 2007/0015396 | A1 | 1/2007 | Mrakovich et al. | |
| 2007/0087619 | A1 | 4/2007 | Nall et al. | |
| 2007/0121326 | A1 | 5/2007 | Nall et al. | |
| 2007/0153508 | A1 | 7/2007 | Nall et al. | |
| 2007/0202723 | A1 * | 8/2007 | Varrin | 439/157 |
| 2008/0030981 | A1 | 2/2008 | Mrakovich et al. | |
| 2008/0112169 | A1 * | 5/2008 | Cunius | 362/250 |
| 2008/0232105 | A1 * | 9/2008 | Saha et al. | 362/267 |

FOREIGN PATENT DOCUMENTS

| | | | |
|---|---|---|---|
| GB | 2409332 | A * | 6/2005 |
| WO | WO 2006/017595 | A2 | 2/2006 |

* cited by examiner

FLEXIBLE LED LIGHTING STRIPS INCLUDING OVERMOLDING ENCASEMENT AND ATTACHED PARALLEL ELECTRICAL CONDUCTORS

BACKGROUND

The following relates to the optoelectronic arts. It finds particular application in illuminated signage. However, the following will find more general application in conjunction with illumination generally, and in lighting applications such as track lighting, illumination of pathways, and so forth.

Flexible lighting strips incorporating light emitting diodes are known. In some known embodiments; these devices include a flexible electrical power cord and a plurality of modules attached to the cord in spaced apart fashion, with each module including a main body supporting one or more light emitting diode (LED) packages. These flexible lighting strips find application in various settings, such as illumination of channel lettering for outdoor signage, lighting of curved walkways, and so forth.

Although such flexible lighting strips are known, useful improvements continue to be sought after to enhance manufacturability, ease of installation, reliability and robustness of the devices. Reliability and robustness, for example, is of concern for all applications, and is of particular concern for outdoor applications in which the LED lighting strip may be exposed to rain, snow, large temperature swings, and other environmental hardships. Ease of installation is also of concern for all applications, and is of particular concern for the outdoor signage industry which represents a sizable national and global market for such flexible lighting strips. For example, flexible lighting strips incorporating light emitting diodes are placed in channel letter housings to form illuminated lettering for demarcating buildings, businesses, and so forth.

The following discloses improvements in flexible lighting strips including light emitting diodes.

BRIEF SUMMARY

In accordance with certain illustrative embodiments shown and described as examples herein, a flexible lighting strip comprises an insulated flexible electrical power cord including generally parallel electrical conductors that are generally secured together, and a plurality of modules spaced apart along and connected with the insulated flexible electrical power cord. Each module includes a circuit board operatively connected with one or more light emitting diode (LED) packages and electrically connected with the insulated flexible electrical power cord to receive electrical power from the insulated flexible electrical power cord. The circuit board has a cavity, indentation, or opening. Each module further includes an overmolding substantially encasing at least the circuit board. The overmolding defines a slot or opening aligned with the cavity, indentation, or opening of the circuit board. The slot or opening is configured to receive an associated fastener to fasten the module without applying substantial mechanical stress to the circuit board.

In accordance with certain illustrative embodiments shown and described as examples herein, a flexible lighting strip comprises an insulated flexible electrical power cord including generally parallel electrical conductors that are generally secured together, and a plurality of modules spaced apart along and connected with the insulated flexible electrical power cord. Each module includes a circuit board operatively connected with one or more light emitting diode (LED) packages, the generally parallel electrical conductors of the insulated flexible electrical power cord being separated from each other at the connection with each module to define a gap that receives and electrically connects with a portion of the circuit board of the module. Each module further includes an overmolding substantially encasing at least the circuit board and the portion of the insulated flexible electrical power cord over which the generally parallel electrical conductors are separated.

In accordance with certain illustrative embodiments shown and described as examples herein, a flexible lighting strip comprises: an insulated flexible electrical power cord including generally parallel electrical conductors that are generally secured together; a plurality of modules spaced apart along and connected with the insulated flexible electrical power cord, each module including a main body supporting one or more light emitting diode (LED) packages, each module electrically connected with the insulated flexible electrical power cord to receive electrical power from the insulated flexible electrical power cord; and a plurality of tiedowns spaced apart along and secured to the insulated flexible electrical power cord.

In accordance with certain illustrative embodiments shown and described as examples herein, a flexible lighting strip comprises an insulated flexible electrical power cord including generally parallel electrical conductors that are generally secured together, and a plurality of modules spaced apart along and connected with the insulated flexible electrical power cord. Each module includes a main body supporting one or more light emitting diode (LED) packages, and a conductive element connected to convey electrical power from the generally parallel electrical conductors of the insulated flexible electrical power cord to the main body, the conductive element including (i) an insulation displacing portion that pierces through insulation of the insulated flexible electrical power cord to electrically contact a selected one or more of the generally parallel electrical conductors and (ii) a barbed or hooked slot defining a recess receiving at least a portion of the insulated flexible electrical power cord and including a retaining barb or hook extending into the recess.

In accordance with certain illustrative embodiments shown and described as examples herein, a flexible lighting strip comprises an insulated flexible electrical power cord including generally parallel electrical conductors that are generally secured together, and a plurality of modules spaced apart along and connected with the insulated flexible electrical power cord. Each module includes: a circuit board operatively connected with one or more light emitting diode (LED) packages and electrically connected with the insulated flexible electrical power cord to receive electrical power from the insulated flexible electrical power cord; an overmolding substantially encasing at least the circuit board, the overmolding including at least one opening accessing the circuit board that corresponds with a positioning pin of a tooling mold used in forming the overmolding; and a sealant disposed over or in the at least one opening, the sealant being effective to prevent water ingress to the circuit board at the at least one opening.

Numerous advantages and benefits of the present invention will become apparent to those of ordinary skill in the art upon reading and understanding the present specification.

BRIEF DESCRIPTION OF THE DRAWINGS

The invention may take form in various components and arrangements of components, and in various process operations and arrangements of process operations. The drawings are only for purposes of illustrating preferred embodiments and are not to be construed as limiting the invention.

FIG. 1 shows a perspective view of a portion of a flexible lighting strip according to a first embodiment.

FIG. 2 shows a perspective view of one of the modules of the flexible lighting strip of FIG. 1.

FIG. 3 shows a perspective view of the module of FIG. 2 with the overmolding removed.

FIG. 4 shows a perspective view of one of the conductive elements of the modules of the first embodiment.

FIG. 5 shows another perspective view of the module of FIG. 3 from a different vantage point with the overmolding removed to reveal the circuit board including a notched portion of the circuit board.

FIG. 6 shows a perspective underside view of the module of FIG. 3, along with an adhesive strip positioned for attachment to the underside.

FIG. 7 shows a perspective view of the second embodiment of the module.

FIG. 8 shows a perspective view of the module of FIG. 7 with the overmolding removed.

DETAILED DESCRIPTION OF PREFERRED EMBODIMENTS

Figure 1:
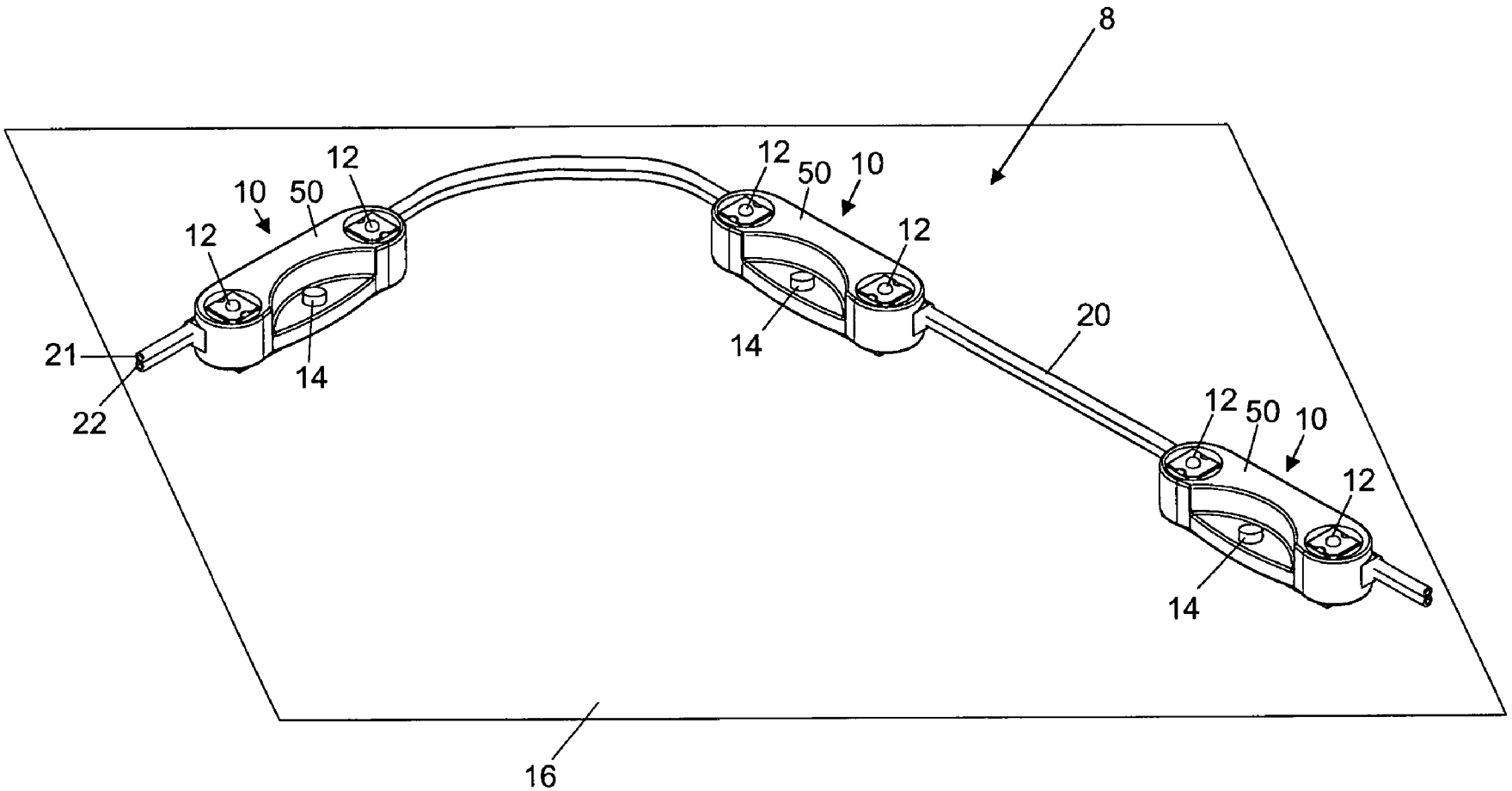
FIGS. 1-6 illustrate a first embodiment.
Figure 2:
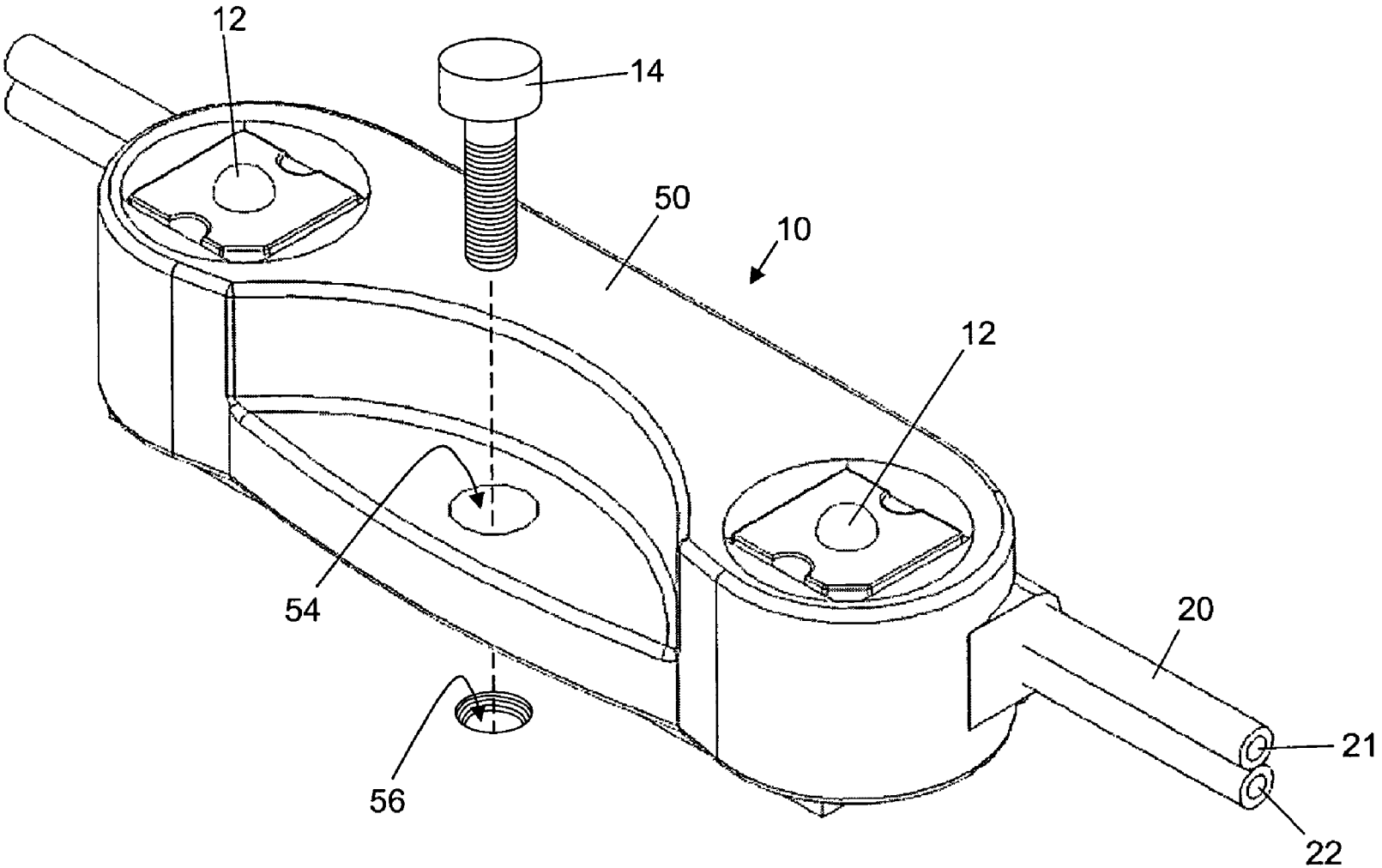

With reference to FIGS. 1-6, a flexible lighting strip 8 includes a plurality of modules 10 each including two light emitting diode (LED) packages 12. Instead of the illustrated two LED packages, each LED module may include one, three, four, five, or more LED packages. Similarly, although the lighting strip 8 of FIG. 1 shows only three modules 10, in a typical installation for channel letter illumination or so forth the flexible lighting strip may include anywhere from two or three modules to several dozen or more modules. Each module 10 is fastened by a suitable fastener, such as an illustrated threaded screw 14, or a rivet, adhesive, or so forth, to a support 16. In some applications, the support 16 is an interior surface of a channel letter housing or other sign housing.

The plurality of modules 10 are electrically interconnected by an insulated flexible electrical power cord 20 including generally parallel electrical conductors that are generally secured together. In the illustrated embodiment, the flexible electrical power cord 20 includes two generally parallel electrical conductors 21, 22 that are generally secured together, which is suitable to enable a parallel interconnection of the modules 10. Although not illustrated, it is to be understood that the generally parallel electrical conductors 21, 22 are electrically energized by a suitable voltage to cause the LED packages 12 to illuminate. In other contemplated embodiments, the flexible electrical power cord 20 may includes three or more generally parallel electrical conductors that are generally secured together, which is suitable to construct a series-parallel electrical interconnection of modules, as set forth for example in Aanegola et al., U.S. Pat. No. 7,114,841 which is incorporated herein by reference in its entirety. In other contemplated embodiments, three or more conductors are included in the flexible electrical power cord to construct an interconnection of the modules 10 in which different modules can be selectively powered by applying electrical power to different selected ones, pairs, or other combinations of the generally parallel electrical conductors, or so forth. For example, some modules may have blue LED packages connected to a blue power conductor of the flexible electrical power cord, others may be red LED packages connected to a red power conductor, and still others may be green LED packages connected to a green power conductor. By selectively energizing one or more of the red, green, and blue power conductors, various colored light, or white light, may be generated.

Each light emitting diode package 12 typically includes a light emitting diode chip made of one or more layers or portions of a group III-nitride semiconductor or semiconductor structure, a group III arsenide semiconductor or semiconductor structure, a group III-phosphide semiconductor or semiconductor structure, another light emissive semiconductor material or layered or otherwise organized arrangement of such semiconductor materials, an organic semiconductor or semiconductor structure, or so forth. The light emitting diode chip is electrically connected to electrical leads or a lead frame and is optionally mechanically sealed by a suitable light-transmissive encapsulant. Optionally, the light emitting diode packages may include other elements, such as a microlens, redundant leads, heat-sinking metallic slug, a submount optionally incorporating electrostatic discharge protection circuitry, a reflective cup containing the light emitting diode chip, a wavelength converting phosphor, or so forth. In some embodiments, a single light emitting diode package may include two or more light emitting diode chips, such as red, green, and blue light emitting diode chips defining an "RGB" type color-controllable light emitting diode package.

Figure 3:
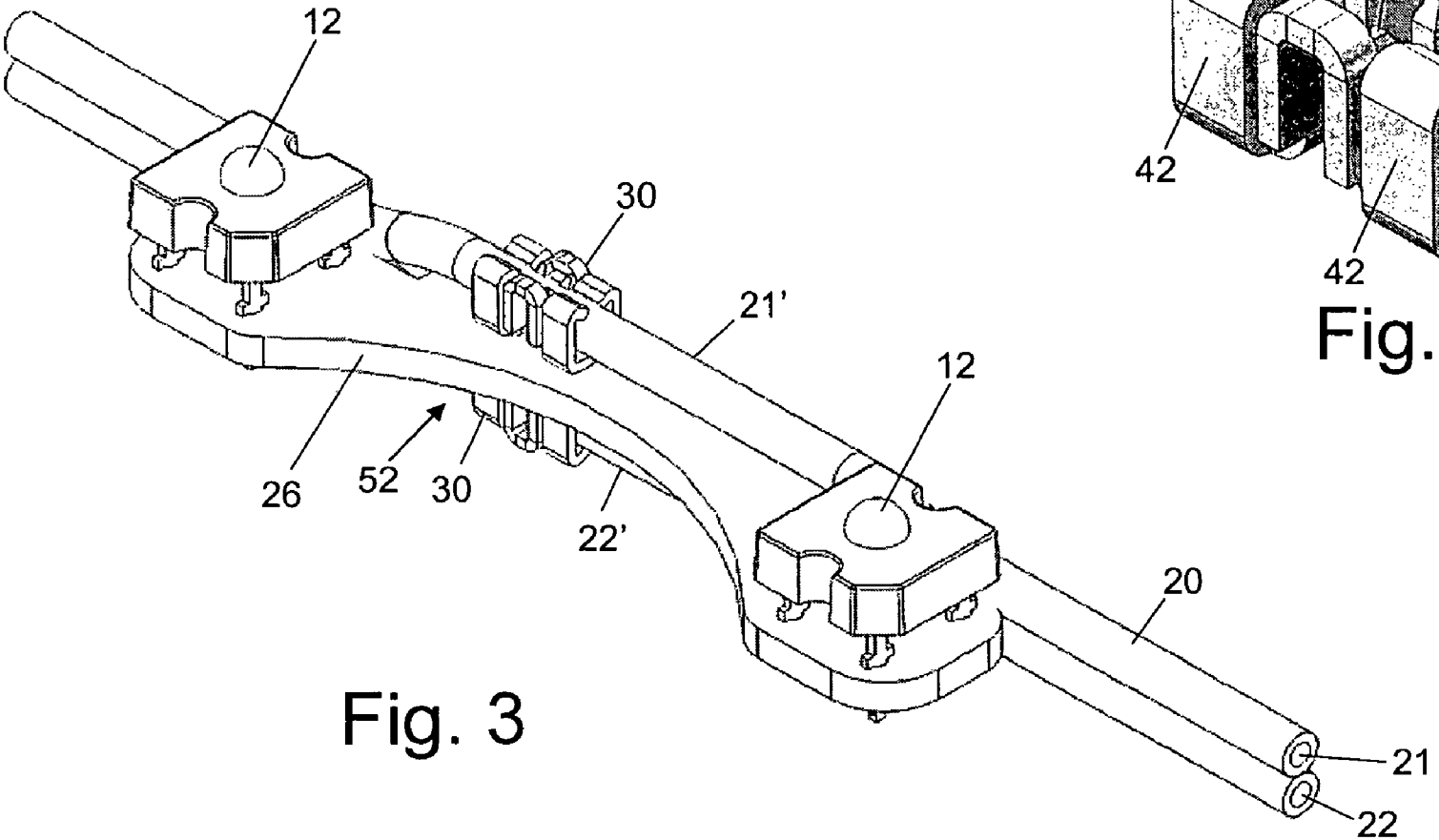

With particular reference to FIG. 3, each module 10 includes a circuit board 26 on which the LED packages 12 are mounted. The circuit board 26 includes circuitry, such as printed circuitry (not shown), that provides a power delivery path from conductive elements 30 disposed on opposite sides of the circuit board 26 to the LED packages 12. Although not shown, the circuit board 26 optionally supports additional components such as power regulation circuitry, electrostatic discharge (ESD) protection, or so forth, such components being suitably embodied as integrated circuit components, discrete components, or a combination thereof.

Figure 4:
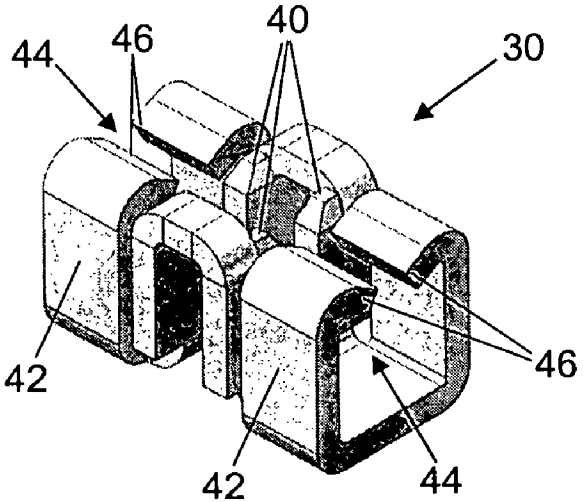
Figure 5:
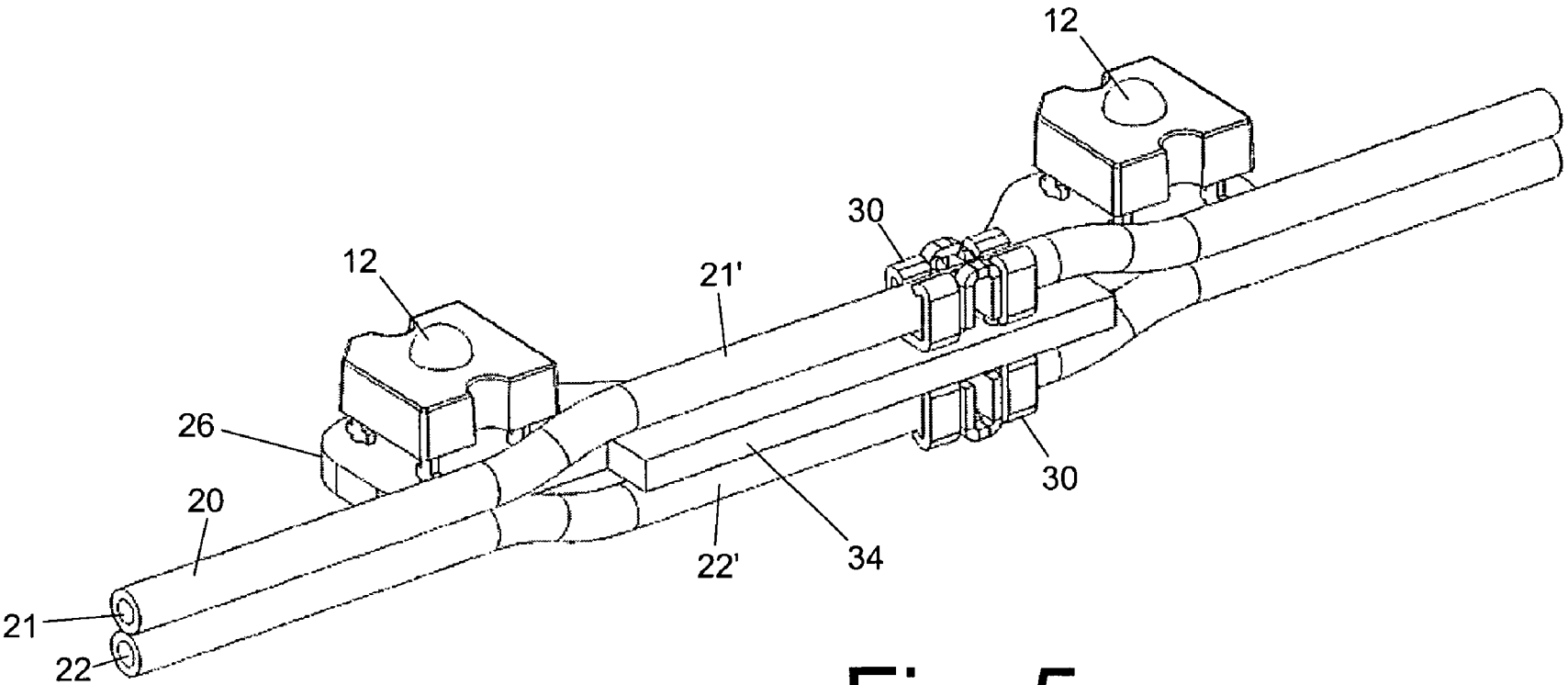

In the embodiment of FIGS. 1-6, and with particular reference to FIG. 5, the insulated flexible electrical power cord 20 includes generally parallel electrical conductors 21, 22 that are generally secured together. However, at the connection of each module 10 to the insulated flexible electrical power cord 20, the generally parallel electrical conductors of the insulated flexible electrical power cord are separated from each other to define separated portions 21', 22' having a gap therebetween that receives a portion 34 of the circuit board 26 of the module 10. This arrangement has certain advantages, including providing a lower profile for the module 10, providing good securing of the module 10 to the insulated flexible electrical power cord 20, and so forth. The conductive elements 30 disposed on opposite sides of the circuit board 26 are connected with the separated generally parallel electrical conductors 21', 22' so as to supply electrical power to the module 10 and to the LED packages 12 in particular via circuitry of the circuit board 26, and optionally through intermediate components such as voltage or current regulating circuitry. One advantage of this arrangement is that the insulated flexible electrical power cord 20, which is generally planar, is oriented with the cord plane transverse to the mounting surface which promotes flexing of the cord in the plane of the surface of the support 16 (best seen in FIG. 1), while the circuit board 26 is positioned with its plane parallel with the mounting surface which enables multiple LED packages 12 to be disposed on the circuit board 26 all illuminating in the same general direction.

With reference to FIGS. 1-6 and with particular reference to FIGS. 3 and 4 and with more particular reference to FIG. 4, in some embodiments the conductive elements 30 are constructed to facilitate rapid assembly of the module as follows. As best seen in FIG. 4, each conductive element 30 includes an insulation-displacing portion 40 that pierces through insulation of the proximate one of the separated generally parallel electrical conductors 21', 22' to electrically connect with the proximate one of the separated generally parallel electrical conductors. Additionally, each conductive element 30 optionally includes a conductor-retaining portion 42 configured to receive and hold the proximate one of the separated generally parallel electrical conductors. In the illustrated embodiments, the conductor-retaining portion 42 includes a barbed or hooked slot defining a recess 44 receiving the proximate one of the separated generally parallel electrical conductors 21', 22' and including barbs or hooks 46 extending into the recess 44 to retain the proximate one of the separated generally parallel electrical conductors 21', 22'. (Note that elements 40, 42, 44, 46 are labeled only in FIG. 4). In addition to facilitating assembly, the conductor-retaining portions 42 promote reliability and robustness by reducing a likelihood of inadvertent dislodging of the separated generally parallel electrical conductors 21', 22' from the conductive elements 30 during the manufacturing process. Although the conductor-retaining portions 42 are advantageous, it is also contemplated to omit these features. For example, a alternative approach is to use conductive elements that include only insulation-displacing portions but not conductor-retaining portions. (It will be appreciated, however, that the insulation displacing portions in such embodiments would have the effect of providing some tendency toward retention of the separated conductors 21', 22' due to the piercing of the insulation by the conductive elements). In another contemplated approach, a portion of each separated generally parallel electrical conductor 21', 22' lying along the circuit board 26 is stripped of insulation and soldered to an underlying electrical pad of the circuitry of the circuit board 26 to provide electrical connection. In such an embodiment, conductor-retaining features are optionally omitted, or optionally retained and mounted to the circuit board 26 and coupled to the conductors 21', 22' to secure the separated generally parallel electrical conductors 21', 22' along the circuit board 26.

To further promote reliability and robustness against ingress of water or other environmental damage, the modules 10 include an overmolding 50 that encases at least the circuit board 26, and preferably also encases the conductive elements 30 and the separated generally parallel electrical conductors 21', 22'. In some suitable injection overmolding approaches, after the LED packages 12 are mounted on the circuit board 26 and the separated generally parallel electrical conductors 21', 22' are connected with the conductive elements 30, the assembly is disposed in an injection region of a tooling mold that includes pins receiving and isolating the LED packages 12. Optionally, a gasket (not shown) is installed on the circuit board to help seal the pins to prevent ingress of the molding material into the pins and over the LED packages 12. In other embodiments, the pin contacts an outer region of the LED package 12 to form a seal protecting a light-emitting central portion of the LED package 12. Once the assembly is loaded into the injection mold, an overmolding material is injected into the tooling mold, optionally under an applied pressure. The injected overmolding material is blocked by the pins and optional cooperating annular gaskets from reaching the LED packages 12. The injected liquid overmolding material solidifies in the tooling mold to form the illustrated overmolding 50. In some embodiments, the overmolding 50 is an injected thermoplastic overmolding. In some embodiments, the overmolding 50 is a polyvinyl chloride (PVC) material. After the injected overmolding material solidifies to define the overmolding 50 having openings defined by the pins that leave the light emitting diode packages 12 exposed, assembly is removed from the mold.

As a further measure to promote robustness and reliability, in the embodiment of FIGS. 1-6 an arrangement is provided to avoid mechanically stressing the circuit board 26 during fastening of the modules 10 to the support 16. It is recognized herein that if the illustrated screw 14 or other mechanical fastener such as a rivet or bolt is secured through the circuit board, this results in stress to the relatively fragile circuit board that would lead to a statistically substantial number of failures during installation, and would produce lower levels of mechanical stress in the circuit boards that do not break during installation that is likely to adversely impact long-term reliability. These difficulties are addressed as follows. The circuit board 26 includes a cavity or indentation 52, as shown, or an opening. Then, the overmolding 50 is formed using a tooling mold that defines the overmolding 50 with a slot or opening 54 aligned with the cavity, indentation, 52 or opening of the circuit board 26. The slot or opening 54 in the overmolding 50 is configured to receive the fastener 14 to fasten the module 10 without applying substantial mechanical stress to the circuit board 26. For example, the illustrative screw fastener 14 passes through the illustrative overmolding opening 54 without passing through the circuit board 26 (due to the cavity or indentation 52) and threads into a threaded hole 56 in the support 16. Optionally, the cavity, indentation, 52 or opening of the circuit board 26 is omitted, and the slot or opening in the overmolding is provided by having the overmolding extend laterally substantially beyond the lateral extend of the circuit board. However, having the slot or opening 54 in the overmolding 50 aligned with the cavity, indentation, 52 or opening of the circuit board 26 has certain advantages. This arrangement ensures that the fastener exerts its fastening force relatively closer to the center of mass of the module 10, which arrangement is less likely to break during installation and provides a more stable fastening that promotes long-term reliability and robustness. Additionally, this arrangement provides a smaller footprint for the module 10, which allows for placement in more confined quarters such as small or narrow illuminated sign housings.

With particular reference to FIG. 5, in the embodiment of FIGS. 1-6 the portion 34 of the circuit board 26 that is received into the gap defined by the separated generally parallel electrical conductors 21', 22' is notched such that the portion 21', 22' of the insulated flexible electrical power cord 20 over which the generally parallel electrical conductors are separated is shorter than the circuit board 26. This arrangement has a beneficial stress-reducing effect on the juncture between the separated generally parallel electrical conductors 21', 22' and the unseparated area. The notches also facilitate having the overmolding 50 fully cover the separated generally parallel electrical conductors 21', 22' such that the cord extending out of the overmolding 50 is not separated. That is, the overmolding 50 substantially encases both the circuit board 26 and the portion 21', 22' of the insulated flexible electrical power cord 20 over which the generally parallel electrical conductors are separated.

Figure 6:
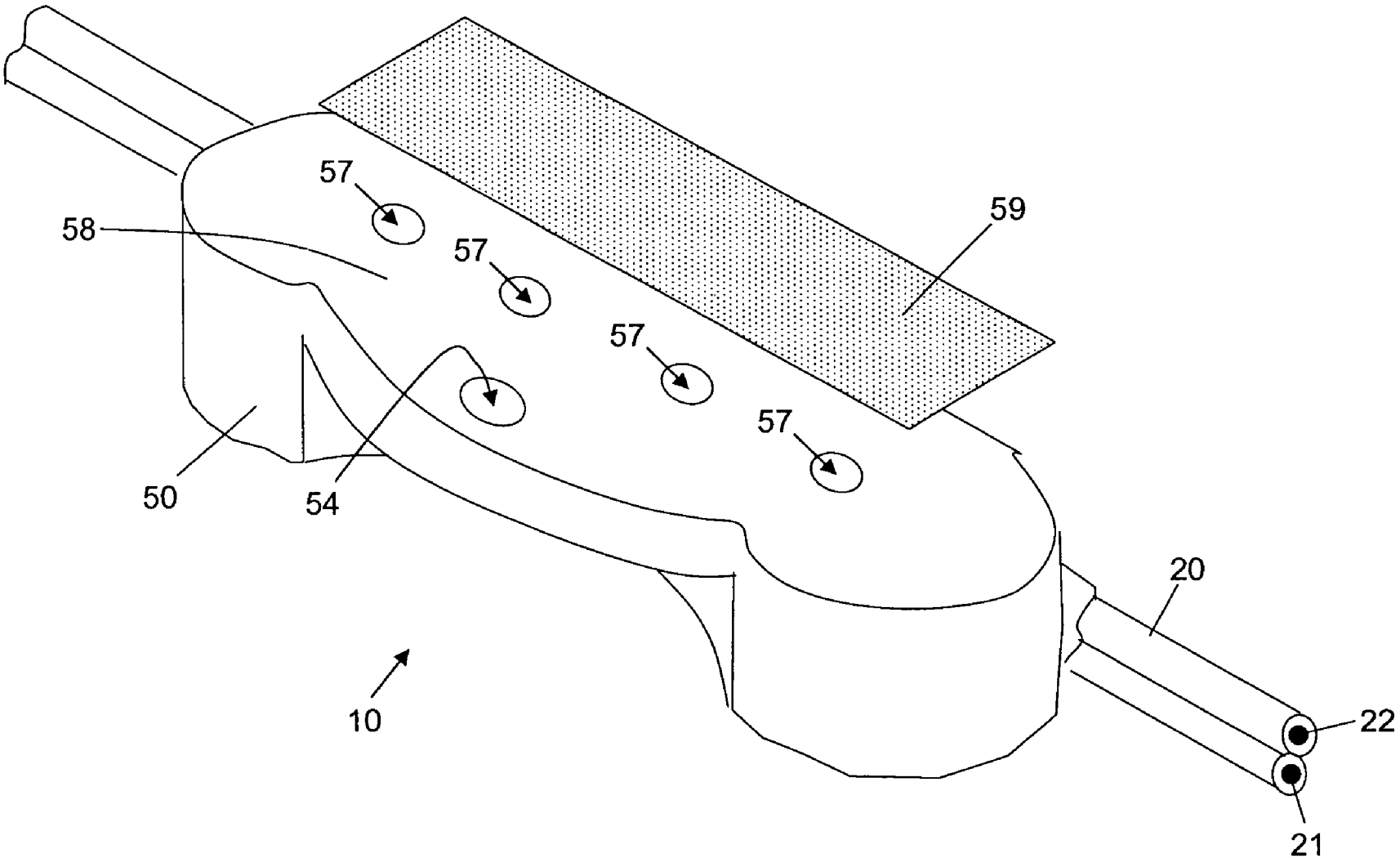

With particular reference to FIG. 6, if the overmolding 50 is formed by injection overmolding or a similar overmolding process, then there are typically one or more openings 57 passing through the overmolding 50 to the circuit board 26 or other encased component. In the illustrated embodiment, some such openings are aligned with the LED packages 12. The pins of the tooling mold that align with the LED packages 12 typically rest upon either the LED package 12 or the surrounding portion of the circuit board 26, and provide frontside stabilizing force to position and hold the assembly in the tooling mold. Backside openings 57 are generated by backside pins that align and provide backside stabilizing force against the circuit board 26 to position and hold the assembly in the tooling mold. After the overmolding material is injected into the tooling mold and solidifies, the tooling mold is removed thus leaving the openings 57 in the backside of the overmolding 50 that access the circuit board 26. Such openings provide potential points for water ingress that can lead to damage of the circuit board 26 or other encased components. It is contemplated to include gaskets that meet with the pins and remain behind after the tooling mold is removed. Such gaskets can form a seal with the overmolding 50 to suppress water ingress. In another approach, shown in FIG. 6, the backside openings 57 exit at a generally planar surface 58 that is covered with an adhesive tape, strip, or so forth 59 (shown in exploded view) to suppress water ingress at the openings 57. In some embodiments, the adhesive strip 59 is advantageously a double-sided adhesive tape having adhesive on both sides of the tape. Such double-sided adhesive tape advantageously can both provide a sealing effect for the openings 57 and also facilitate positioning of the module 10 on the support 16. In some embodiments, it is contemplated for such double-sided adhesive tape to serve as the sole mechanism for securing the module 10 to the support 16, in which case the fastening opening 54 is optionally omitted. In some embodiments, it is contemplated for such double-sided tape to serve as a positioning aid, but to rely upon the fastener 14 inserted into the fastening opening 54 to secure the module 10 to the support 16. In some embodiments, the adhesive strip 59 is VHB™ tape (available from 3M™, St. Paul, Minn.). The openings 57 exit at the generally planar surface 58 disposed on a backside of the module 10 opposite the frontside where the LED modules 12 are mounted. This is advantageous because it places the openings 57 far from most electrically active components, so that even if some water ingresses the likelihood of electrical component degradation is reduced. Sealing the bottom side openings 57 by the illustrated adhesive tape or strip 59, or by epoxy or another sealant, further reduces a likelihood of water ingress-related degradation. While it is advantageous to have the openings on the backside, it is also contemplated for the openings to exit at a side other than the backside, such as at a generally planar sidewall that may optionally also be used as a mounting surface for mounting the module to the support 16.

Figure 7:
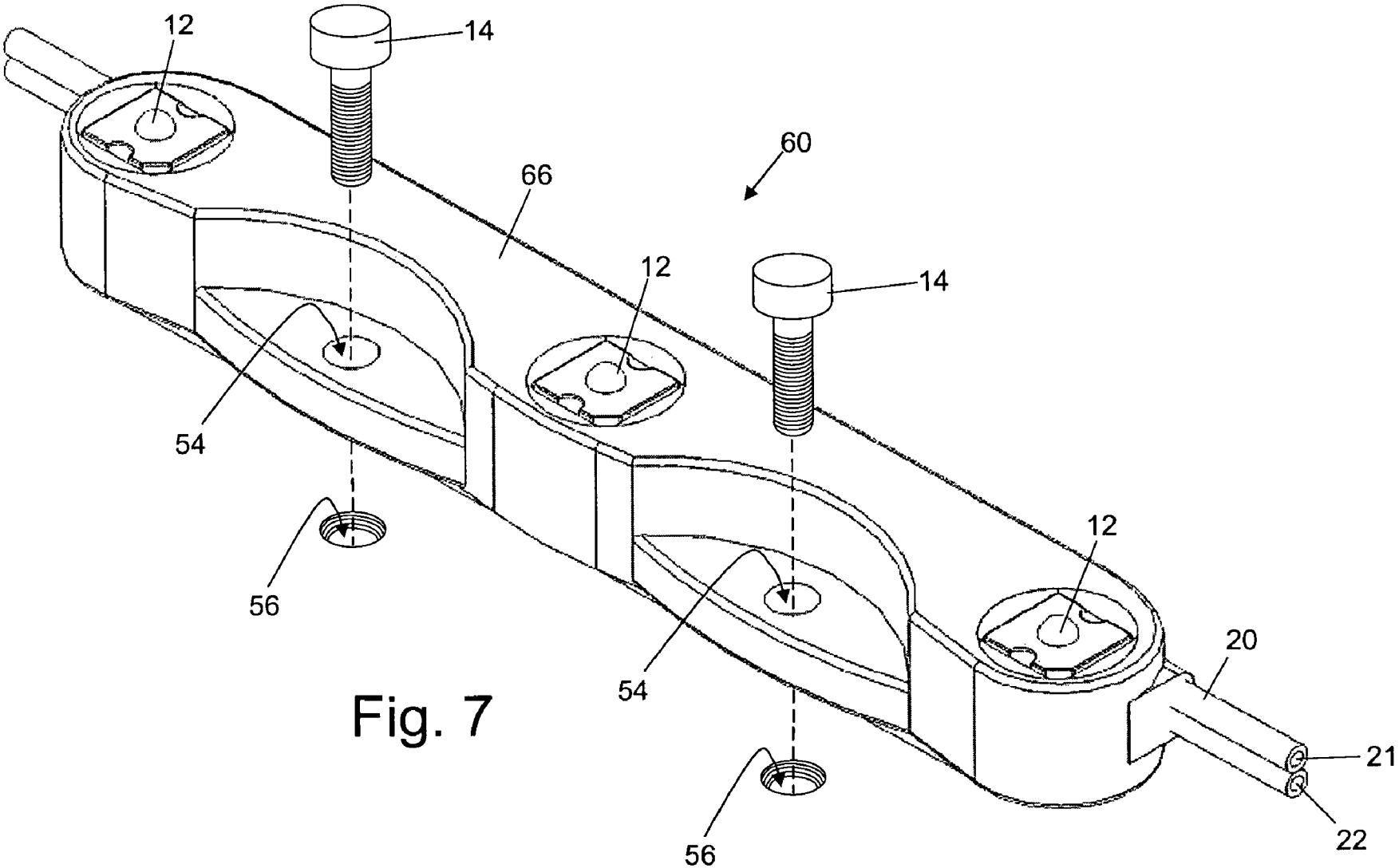
FIGS. 7 and 8 show a second embodiment of a module that includes three light emitting diode (LED) packages.
Figure 8:
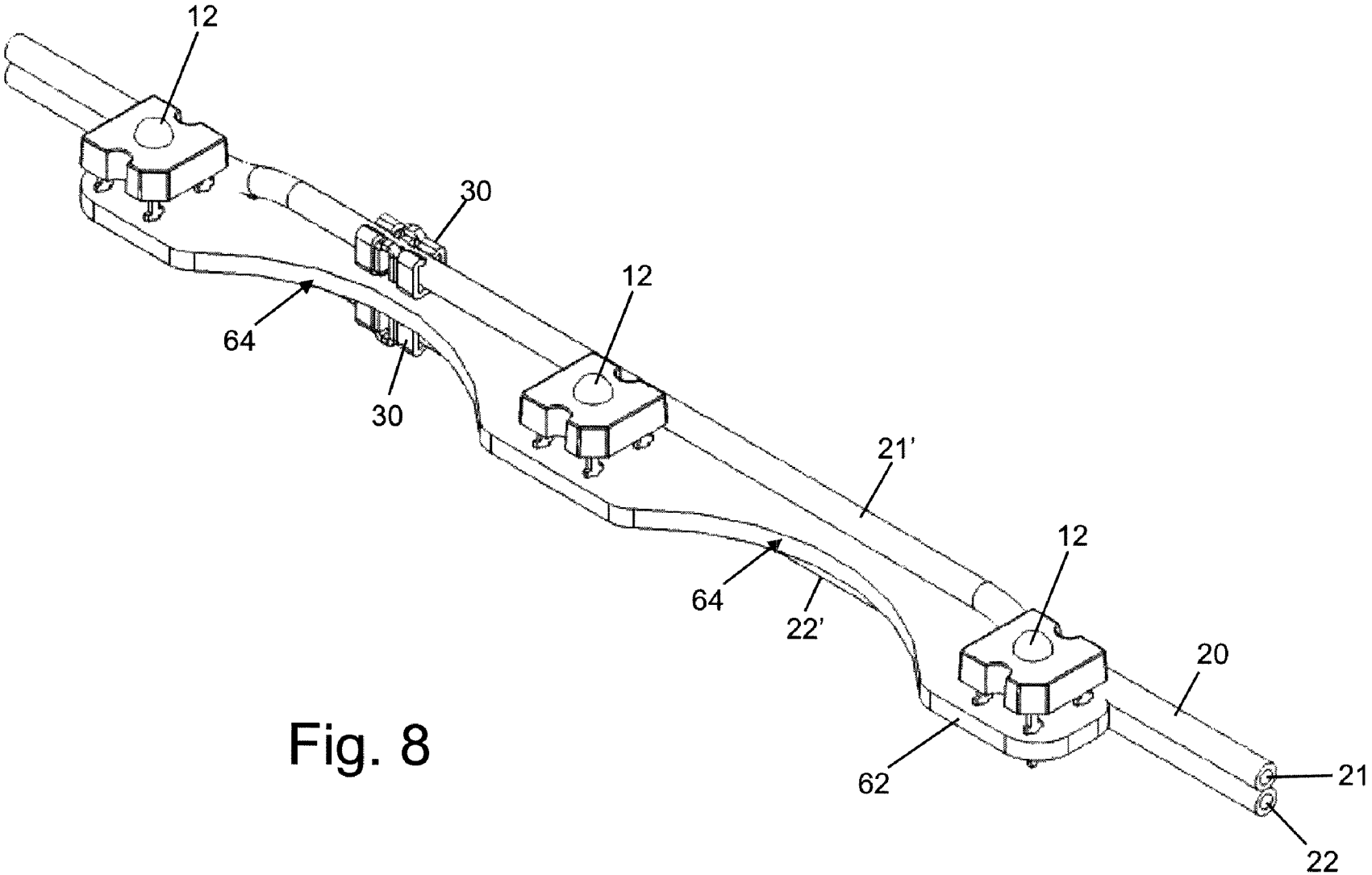

With reference to FIGS. 7 and 8, a second embodiment module 60 includes a longer circuit board 62 suitable for supporting three LED packages 12. The longer circuit board 62 has two cavities or indentations 64, and a correspondingly longer overmolding 66 includes two openings 54 aligned with the two cavities or indentations 64. The modules 10, 60 are illustrative examples, and it is contemplated to include only some of the manufacturability, reliability, and robustness enhancing features in various embodiments. For example, in one contemplated variation (not shown), the electrical conductors of the insulated flexible electrical power cord are not separated at the connection with the module, but rather both conductors (for a two conductor cord embodiment) pass on the same side of the circuit board. Such an embodiment suitably omits the notched portion 34 of the circuit board, but suitably includes the conductive elements 30 with one or more a conductor-retaining portions sized to receive the entire cord, and suitably retains the circuit board cavity or indentation aligning with a fastening opening or slot in the overmolding. In the illustrated embodiments the modules 10, 60 each have a main body including at least the circuit board 26, 62 and the overmolding 50, 66. As another example of a contemplated variant embodiment, each module may include a main body that does not include the illustrated circuit board or overmolding, but which is connected with the insulated flexible electrical power cord by the conductive elements 30 configured as illustrated with both insulation displacing and conductor-retaining portions.

Figure 9:
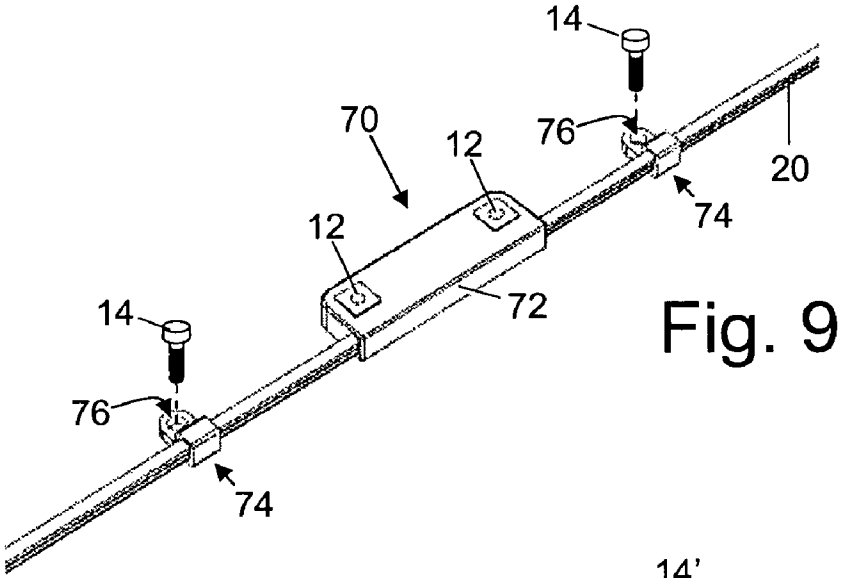
FIG. 9 shows an embodiment including a tiedown secured to the insulated flexible electrical power cord and not connected with and not integral with any of the modules.

With reference to FIG. 9, as noted previously the arrangement of an overmolding having a fastening opening or slot that aligns with a cavity, indentation, or opening of the circuit board advantageously substantially reduces mechanical stress on the circuit board during and after installation, thus increasing ease and reliability of installation and long-term robustness and reliability. However, the direct fastening of the modules 10, 60 to the support 16 does produce some mechanical stress on the modules 10, 60 overall, and potentially some residual stress on the encased circuit board 26 in particular. To further enhance ease and reliability of installation and long-term operational reliability and robustness, in the embodiment of FIG. 9 a modified module 70 is used, which includes two LED packages 12 and an overmolding 72, but with no provision in the overmolding 72 or elsewhere in the module 70 for fastening the module to the support 16. Instead, tiedowns 74 are separately secured to the insulated flexible electrical power cord 20 and are not connected with and not integral with any of the modules 70. The illustrated tiedowns 74 include a fastening structure having an opening 76 or slot configured to receive one of the fasteners 14. In this way, the mechanical stress of the fastening is borne entirely by the separate tiedowns 74 and does not impact the modules 70. The tiedowns 74 are suitably formed by overmolding onto the insulated flexible electrical power cord 20, and in some embodiments are made using the same injection overmolding process used to form the overmolding 72. In such an approach, the tiedowns 74 and the module overmolding 72 are formed in a single-step overmolding process using a tooling mold having three separate injection cavities—one to form the overmolding 72, and two additional separate injection cavities on either side of the module used to form the tiedowns 74. In such embodiments, each tiedown 74 is an overmolding encasing a portion of the flexible electrical power cord 20 at which the tiedown 74 connects with the flexible electrical power cord 20.

Figure 10:
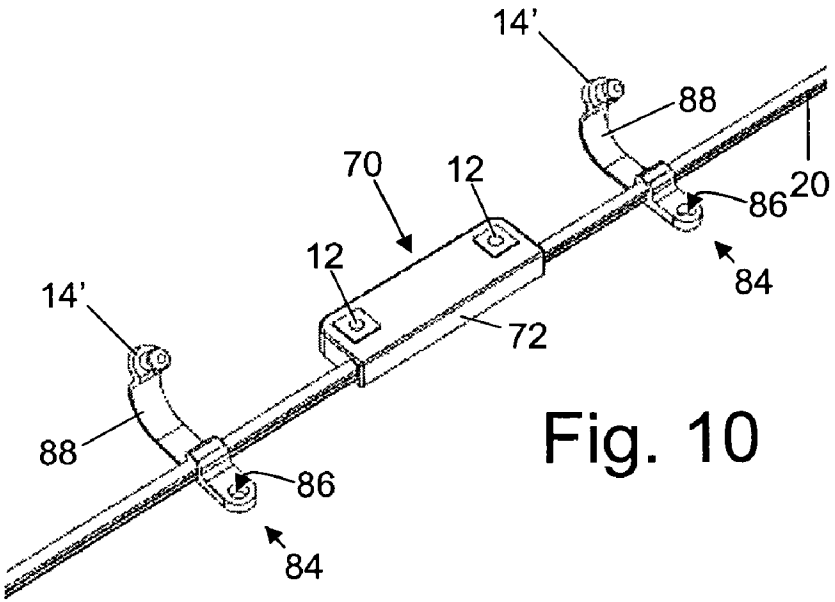
FIG. 10 shows an embodiment including a tiedown secured to the insulated flexible electrical power cord and including an attached fastener.

With reference to FIG. 10, a variant embodiment includes the modules 70 as in the embodiment of FIG. 9, and further includes separate, isolated tiedowns 84 corresponding to the tiedowns 74 of FIG. 9 and including openings 86 corresponding to the openings 76 of the tiedowns 74. However, the tiedowns 84 differ from the tiedowns 74 in that each tiedown 84 further includes an integral fastener 14' and an integrally formed connecting member 88 connecting the integral fastener 14' and the fastening structure including the opening 86. The connecting member is bendable or breakable to enable the integral fastener 14' to be received into the opening 84 or slot of the fastening structure. For example, in some embodiments the connecting member 88 is highly elastically bendable so that the integral fastener 14' can be inserted into the opening 84 with the connecting member 88 bent but not broken. In other embodiments, the connecting member 88 is breakable so that the integral fastener 14' can be removed during installation and inserted into the opening 84. In a suitable manufacturing approach, the tiedowns 84 are formed by overmolding onto the insulated flexible electrical power cord 20 as described for the tiedowns 74. In such embodiments, the module overmolding 72, the integral fastener 14', the connecting member 88, and the fastening structure having the opening 84 are all made of the same material, such as PVC if that is the selected overmolding material. In another suitable manufacturing approach, the fastener 14' can be an insert molded fastener, such as a self-drilling screw, rivet, or plastic fastener to be inserted into a pre-drilled hole in the back plane.

Figure 11:
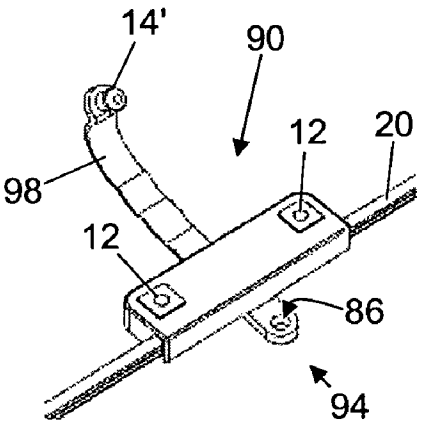
FIG. 11 shows an embodiment including a module with an integral tiedown including an attached fastener.

With reference to FIG. 11, while certain advantages to having tiedowns separate from the modules have been set forth, it is also contemplated to have one or more tiedowns with integral fasteners formed integrally with and physically connected with a module. FIG. 11 illustrates such a module 90 including two LED packages 12 secured to the insulated flexible electrical power cord 20, and further including an integral tiedown 94 with the opening 86, the integral fastener 14', and a longer integrally formed connecting member 98 retaining the integral fastener 14' with the module 90. The longer connecting member 98 enables the fastener 14' to be brought over the top of the module 90 to reach the opening 86. Alternatively, if the connecting member is broken to release the fastening member 14' before insertion into the opening 86, then a shorter connecting member can be used. The module 90 can be formed as an integrated unit by overmolding.

Having the tiedowns 84, 94 overmolded on the insulated flexible electrical power cord 20 promotes easy installation. For example, in an illuminated cabinet application, the cabinet designer sometimes uses a numerically controlled router that both cuts out the backplane of the cabinet and pre-drills holes in the backplane. In such a case, the flexible lighting strip of FIG. 10 or of FIG. 11 can then be installed with no needed additional components—the fasteners 14' are integrally included with the flexible lighting strip. This simplifies installation process, because only a single part is ordered (the flexible lighting strip of FIG. 10 or of FIG. 11). If the installation is performed on-site there is no possibility that the installer will forget to bring fasteners or will bring too few fasteners to complete the installation.

Where tiedowns that are separate from the modules are included, the separate tiedowns 74, 84 can be used in various combinations with various modules. For example, although the tiedowns 74, 84 are illustrated in conjunction with the modules 70 that do not have fastener-receiving slots or openings, it is also contemplated to use the tiedowns 74, 84 in conjunction with the modules 10 or the modules 60 which do have fastener-receiving slots or openings 54. Moreover, in some contemplated embodiments the separate tiedowns 74, 84 are overmolded onto the insulated flexible electrical power cord 20 as described, but the modules are snap-on units that do not include overmolding, may or may not include a circuit board, and may or may not include fastener-receiving slots or openings. Such overmolded tiedowns can improve manufacturing efficiency even when the modules are snap-on units that do not include corresponding overmolding. For example, in one contemplated manufacturing approach, the tiedowns are overmolded onto the insulated flexible electrical power cord in an automated fashion in which a feeder advances the cord a preset distance, the tooling mold closes and a tiedown is formed by injection molding, the tooling mold automatically opens, the power cord is advanced another preset distance, and the process repeated to form overmolded tiedowns spaced apart by the preset distance along the power cord. Then, the snap-on modules can be attached either at the manufacturing plant or later, for example at the installation site. If the snap-on modules are attached at the manufacturing plant, then the aforementioned benefits of having a single part that can be ordered and installed without concern about separately ordering or providing a sufficient number of fasteners is again realized.

The preferred embodiments have been illustrated and described. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. An apparatus comprising:

a flexible lighting strip including a plurality of insulated electrical conductors and a plurality of modules spaced apart along and connected with the plurality of insulated electrical conductors, each module including:

a circuit board operatively connected with one or more light emitting diode (LED) packages and electrically connected with the plurality of electrical conductors to receive electrical power from the plurality of electrical conductors, a first edge of the circuit board having a cavity or indentation, and an encasement substantially encasing at least the circuit board, the encasement including a slot or opening overlapping the cavity or indentation of the first edge of the circuit board such that a fastener passing through the slot or opening to fasten the module to an associated support does not pass through the circuit board.

2. The apparatus as set forth in claim 1, wherein at the connection of each module to the plurality of electrical conductors the conductors are spaced apart from each other to define a gap that receives the circuit board of the module, and the module further comprises:

conductive elements disposed on opposite sides of the circuit board and electrically connected with the spaced apart plurality of electrical conductors to convey electrical power from the spaced apart electrical conductors to the circuit board.

3. The apparatus as set forth in claim 2, wherein the conductive elements include insulation-displacing portions that pierce through insulation of the spaced apart plurality of electrical conductors to connect therewith.

4. The apparatus as set forth in claim 2, wherein the circuit board includes a notched portion that is received into the gap defined by the spaced apart plurality of electrical conductors, the notched portion of the circuit board being shorter than the circuit board.

5. The apparatus as set forth in claim 1, wherein each module further comprises:

conductive elements electrically connected with at least some of the plurality of insulated electrical conductors to convey electrical power from the plurality of insulated electrical conductors to the circuit board, each conductive element including:

an insulation-displacing portion that pierces through insulation of plurality of insulated electrical conductors to electrically contact a selected one of the plurality of insulated electrical conductors, and a barbed or hooked slot defining a recess receiving at least a portion of the plurality of insulated electrical conductors and including retaining barbs or hooks extending into the recess.

6. The apparatus as set forth in claim 1, further comprising:

a tiedown secured to the plurality of insulated electrical conductors and not connected with and not integral with any of the modules.

7. The apparatus as set forth in claim 1, wherein the encasement comprises an overmolding.

8. The apparatus as set forth in claim 7, wherein the overmolding includes at least one opening accessing the circuit board, and each module further comprises:

an adhesive tape or strip disposed over the at least one opening accessing the circuit board, the adhesive tape or strip being effective to prevent water ingress to the circuit board at the at least one opening accessing the circuit board.

9. An apparatus comprising:

a flexible lighting strip including a plurality of insulated electrical conductors and a plurality of modules spaced apart along and connected with the plurality of insulated electrical conductors, each module including:

a circuit board having a front side and an opposite back side, wherein the circuit board is operatively connected with one or more light emitting diode (LED) packages disposed on the front side, there being no LED packages disposed on the back side, first and second electrical conductors of the plurality of insulated electrical conductors being spaced apart from each other at the connection with the module to define a gap that receives the circuit board of the module with the first conductor of the plurality of insulated electrical conductors disposed on the front side of the circuit board and the second conductor of the plurality of insulated electrical conductors disposed on the opposite back side of the circuit board, and first and second conductive elements respectively disposed on the front side and opposite back side of the circuit board and respectively electrically connecting with the first and second conductors of the plurality of insulated electrical conductors disposed on the front side and opposite back side of the circuit board to deliver electrical power from the plurality of insulated electrical conductors to the circuit board.

10. The apparatus as set forth in claim 9, wherein the conductive elements disposed on the front side and opposite back side of the circuit board include insulation-displacing portions that pierce through insulation of the respective first and second conductors to electrically connect therewith.

11. The apparatus as set forth in claim 9, wherein the conductive elements comprise:

conductor-retaining portions configured to receive and hold the spaced apart first and second conductors respectively disposed on the front side and opposite back side of the circuit board.

12. The apparatus as set forth in claim 11, wherein the conductor-retaining portion of each conductive element comprises:

a barbed or hooked slot defining a recess and including barbs or hooks extending into the recess to retain in the recess the proximate one of the spaced apart first and second conductors of the generally parallel electrical conductors respectively disposed on the front side and opposite back side of the circuit board.

13. The apparatus as set forth in claim 9, wherein the circuit board includes a notched portion that is received into the gap defined by the spaced apart first and second electrical conductors such that the notched portion of the circuit board over which the spaced apart first and second electrical conductors are disposed on respective front and opposite back sides of the circuit board is shorter than a longest dimension of the circuit board.

14. The apparatus as set forth in claim 9, further comprising:

a tiedown secured to the plurality of insulated electrical conductors, the tiedown including a fastening structure having an opening or slot configured to receive a fastener for fastening the flexible lighting strip to an associated support.

15. The apparatus as set forth in claim 14, wherein the tiedown further comprises:

said fastener; and an integrally formed connecting member connecting the fastener and the fastening structure, the connecting member being bendable or breakable to enable the fastener to be received into the opening or slot of the fastening structure.

16. The apparatus as set forth in claim 9, wherein each module further comprises:

an overmolding substantially encasing at least the circuit board and the first and second conductors disposed over the respective front and opposite back sides of the circuit board.

17. The apparatus as set forth in claim 9, wherein each module further comprises:

conductor retaining features disposed on the first and opposite second sides of the circuit board to secure the first and second conductors of the plurality of insulated electrical conductors to respective front and opposite back sides of the circuit board.

18. A flexible lighting strip comprising:

an insulated flexible electrical power cord including generally parallel electrical conductors that are generally secured together;

a plurality of modules spaced apart along and connected with the insulated flexible electrical power cord, each module including a main body supporting one or more light emitting diode (LED) packages, each module electrically connected with the insulated flexible electrical power cord to receive electrical power from the insulated flexible electrical power cord; and a plurality of tiedowns spaced apart along and secured to the insulated flexible electrical power cord, wherein the tiedown comprises an integrally formed fastener, fastening structure, and connecting member, the fastening structure having an opening or slot configured to receive the fastener, the connecting member connecting the fastener and the fastening structure, the connecting member being bendable or breakable to enable the fastener to be received into the opening or slot of the fastening structure, and wherein the tiedowns are integrated with the modules such that each module includes one or more integrated tiedowns each of which tiedowns includes an integrally fowled fastener, fastening structure, and connecting member.

19. An apparatus comprising:

a flexible lighting strip including a plurality of insulated electrical conductors and a plurality of modules spaced apart along and connected with the plurality of insulated electrical conductors, each module including:

a circuit board having a first side and an opposite second side, wherein the circuit board is operatively connected with one or more light emitting diode (LED) packages, first and second electrical conductors of the plurality of insulated electrical conductors being spaced apart from each other at the connection with the module to define a gap that receives the circuit board of the module with the first conductor of the plurality of insulated electrical conductors disposed on the first side of the circuit board and the second conductor of the plurality of insulated electrical conductors disposed on the opposite second side of the circuit board, and first and second conductive elements respectively disposed on the first and opposite second sides of the circuit board and respectively electrically connecting with the first and second conductors of the plurality of insulated electrical conductors disposed on the first and opposite second sides of the circuit board to deliver electrical power from the plurality of insulated electrical conductors to the circuit board, wherein the plurality of insulated electrical conductors define a generally planar cord having a cord plane oriented transverse to the first and opposite second sides of the circuit board, and the one or more LED packages are disposed on the first side of the circuit board.

* * * * *